US012553427B2

(12) United States Patent
Kim et al.

(10) Patent No.: US 12,553,427 B2
(45) Date of Patent: Feb. 17, 2026

(54) RECIPROCATING COMPRESSOR

(71) Applicant: LG ELECTRONICS INC., Seoul (KR)

(72) Inventors: Younghwan Kim, Seoul (KR); Jongmok Lee, Seoul (KR); Sangmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/874,704

(22) PCT Filed: Jul. 27, 2022

(86) PCT No.: PCT/KR2022/011022
§ 371 (c)(1),
(2) Date: Dec. 13, 2024

(87) PCT Pub. No.: WO2023/243761
PCT Pub. Date: Dec. 21, 2023

(65) Prior Publication Data

US 2025/0361857 A1 Nov. 27, 2025

(30) Foreign Application Priority Data

Jun. 15, 2022 (KR) ..... 10-2022-0072860

(51) Int. Cl.
*F04B 39/00* (2006.01)
*F04B 35/04* (2006.01)
*F04B 39/12* (2006.01)

(52) U.S. Cl.
CPC ..... *F04B 39/0088* (2013.01); *F04B 35/04* (2013.01); *F04B 39/123* (2013.01)

(58) Field of Classification Search
CPC ..... F04B 39/0061; F04B 39/0088; F04B 39/123; F04B 35/04; F04B 53/001; Y10S 181/403
See application file for complete search history.

(56) References Cited

U.S. PATENT DOCUMENTS

2005/0106038 A1 5/2005 Yoon et al.
2018/0180036 A1* 6/2018 Cho ..... F16L 13/103

FOREIGN PATENT DOCUMENTS

CN 100373049 3/2008
CN 108278191 7/2018
(Continued)

OTHER PUBLICATIONS

International Search Report dated Sep. 20, 2023 issued in Application No. PCT/KR2022/011022.
(Continued)

*Primary Examiner* — Loren C Edwards
(74) *Attorney, Agent, or Firm* — KED & ASSOCIATES

(57) ABSTRACT

A reciprocating compressor according to an embodiment of the present disclosure includes a discharge unit including a first discharge muffler including a first muffler body and a first muffler cover coupled to the first muffler body; a second discharge muffler including a second muffler body and a second muffler cover coupled to the second muffler body; a first discharge hose connecting the first discharge muffler and the second discharge muffler; and a second discharge hose connecting the second discharge muffler to a discharge pipe coupled to a hermetic container. The first discharge hose connecting the first discharge muffler and the second discharge muffler is formed of a flexible material, and the second discharge hose connecting the second discharge muffler and the discharge pipe is formed of a metal material. The reciprocating compressor can effectively block vibration generated in a compressor body, can securely maintain the connection between the discharge hose and the discharge pipe, and can effectively reduce noise of a desired frequency by controlling volume of the first and second discharge mufflers.

17 Claims, 11 Drawing Sheets

(56) References Cited

FOREIGN PATENT DOCUMENTS

| | | |
|---|---|---|
| KR | 20-2000-0013451 | 7/2000 |
| KR | 10-1377304 | 3/2014 |
| KR | 10-1855014 | 5/2018 |
| KR | 10-1855047 | 5/2018 |
| KR | 10-1996488 | 7/2019 |
| KR | 10-2022-0018324 | 2/2022 |

OTHER PUBLICATIONS

Korean Office Action dated Oct. 13, 2023, issued in Application No. 10-2022-0072860.
Korean Notice of Allowance dated Mar. 7, 2024, issued in Application No. 10-2022-0072860.

* cited by examiner

【FIG. 1】
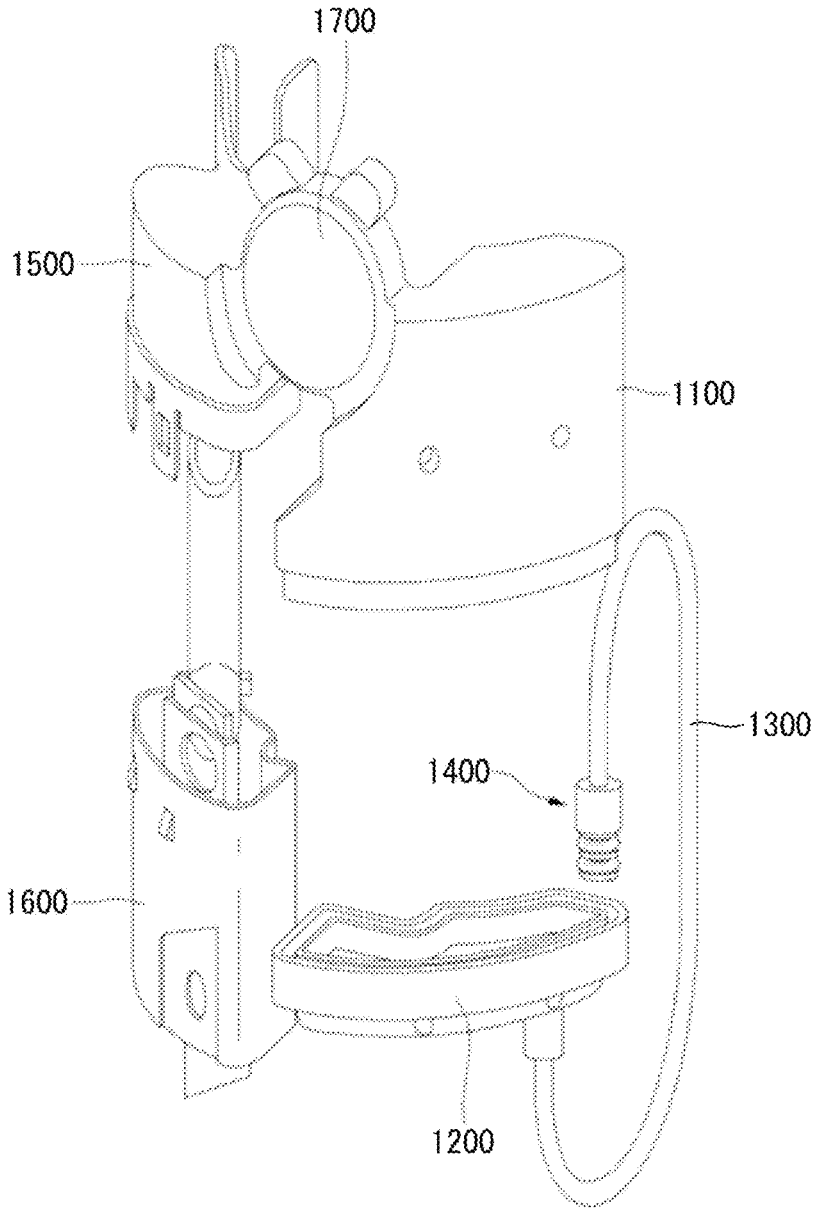

【FIG. 2】
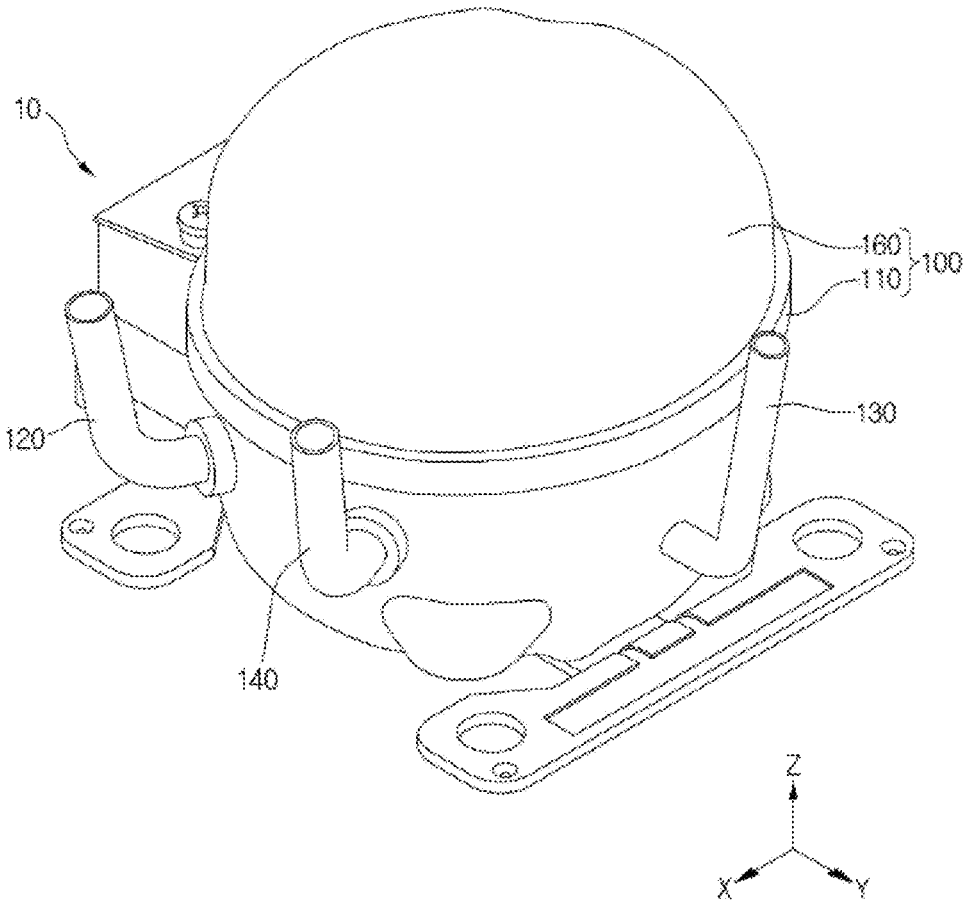

【FIG. 3】
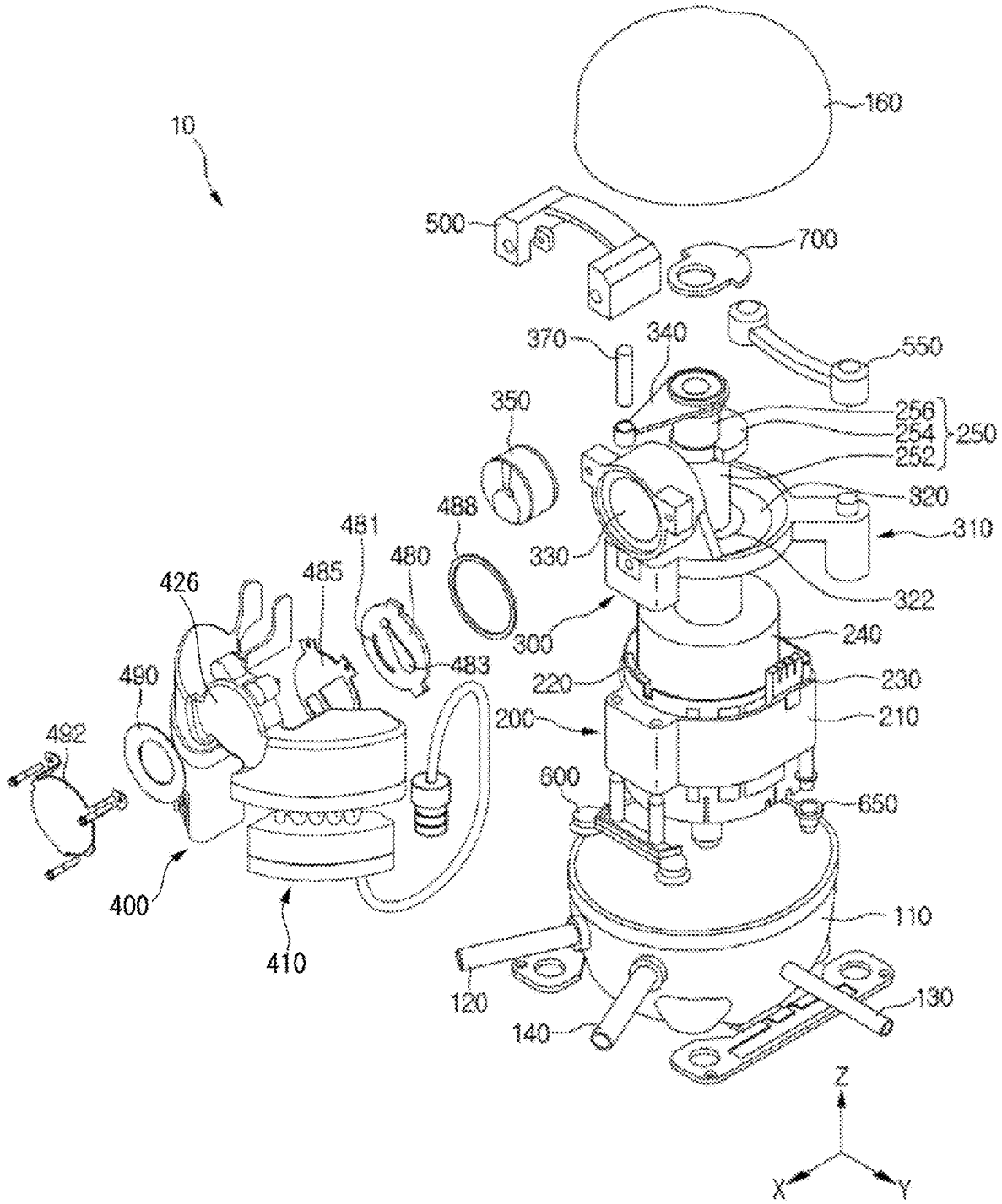

【FIG. 4】
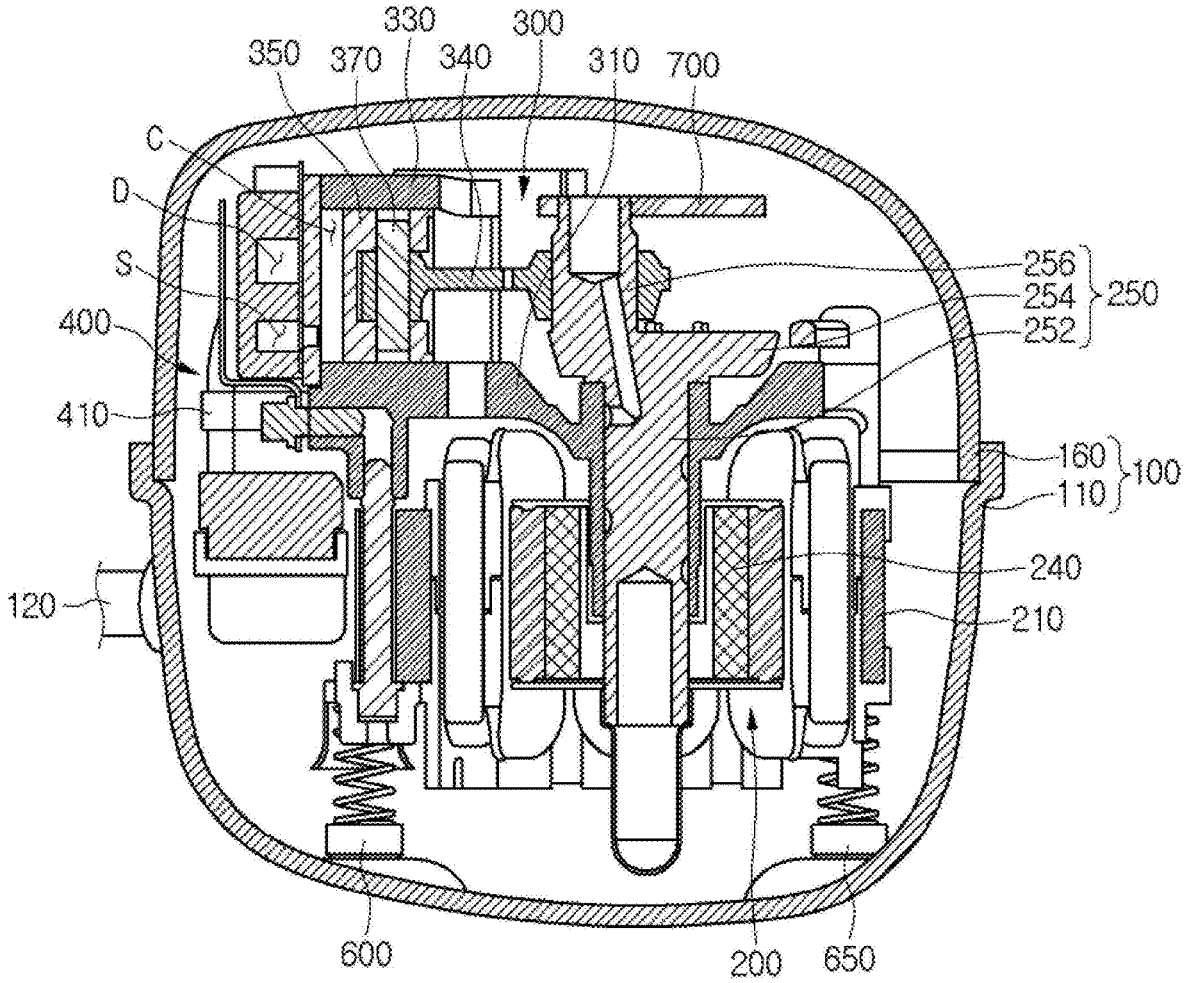

【FIG. 5】
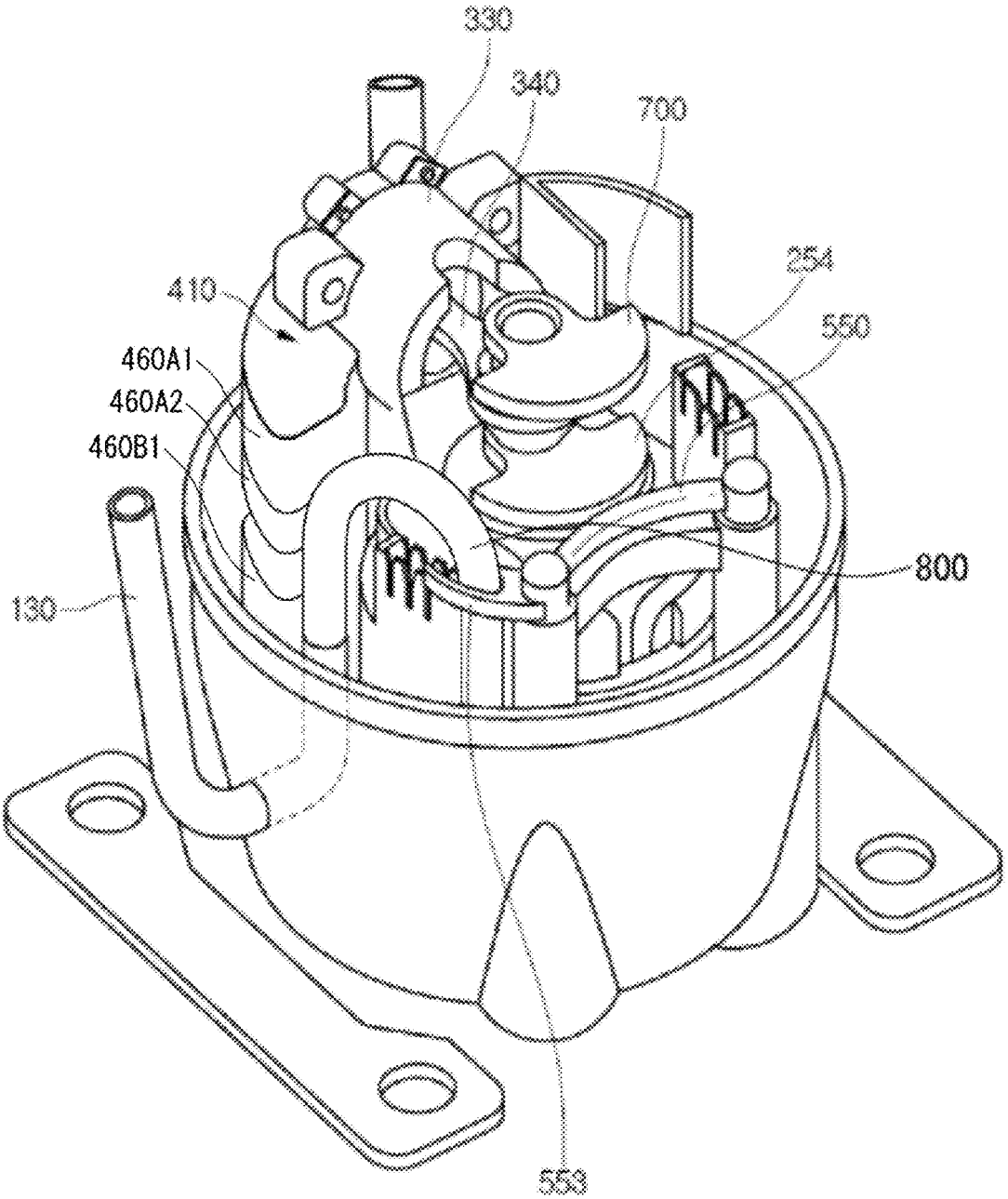

【FIG. 6】
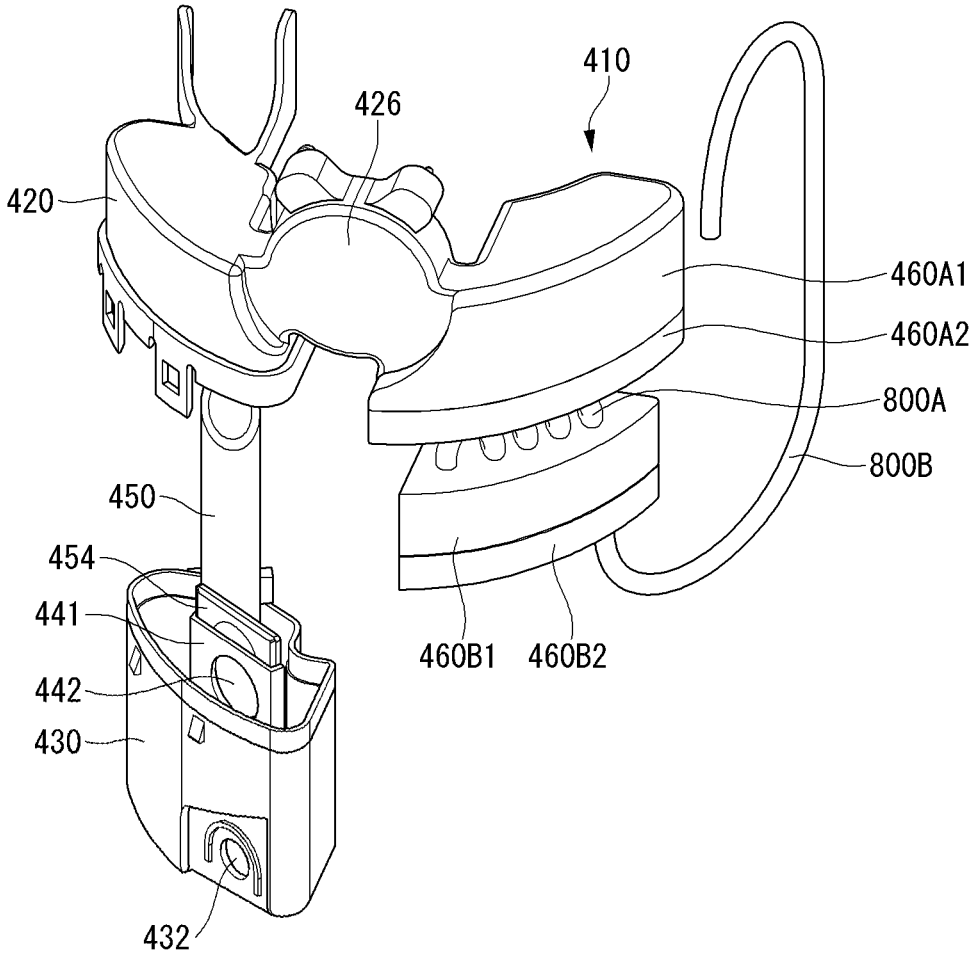

【FIG. 7】
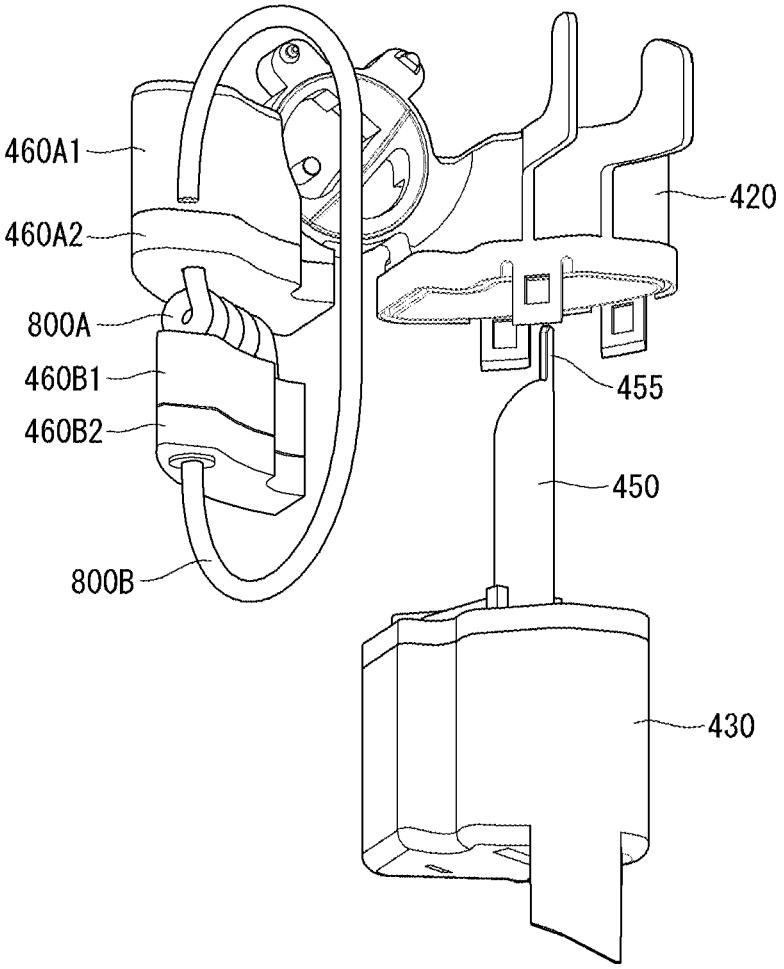

【FIG. 8】
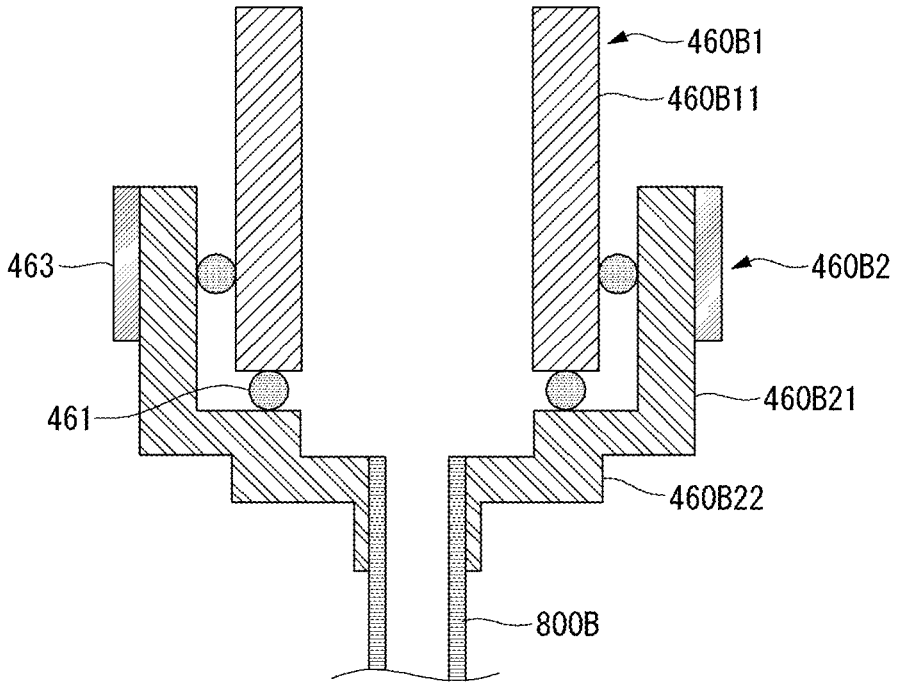
【FIG. 9】
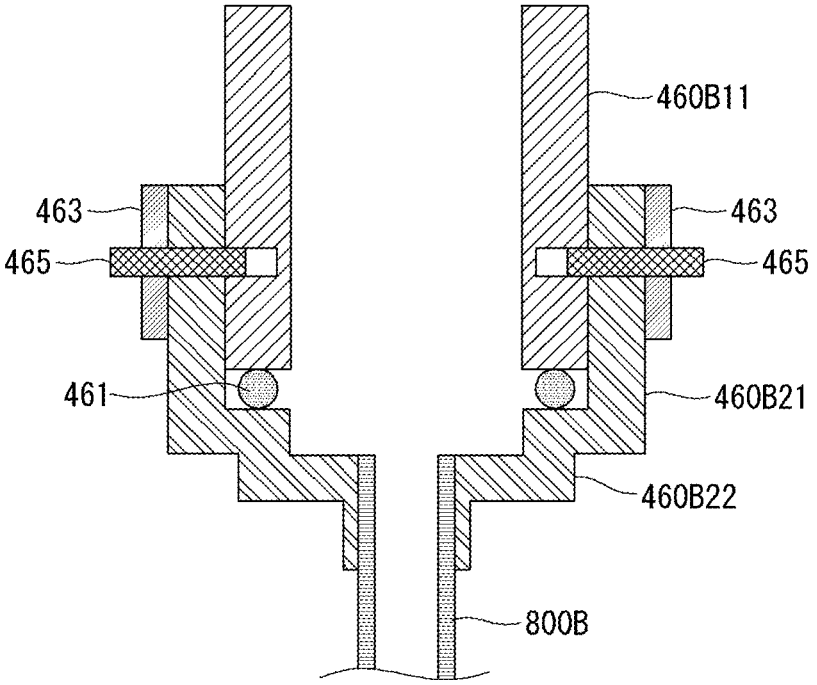

【FIG. 10】
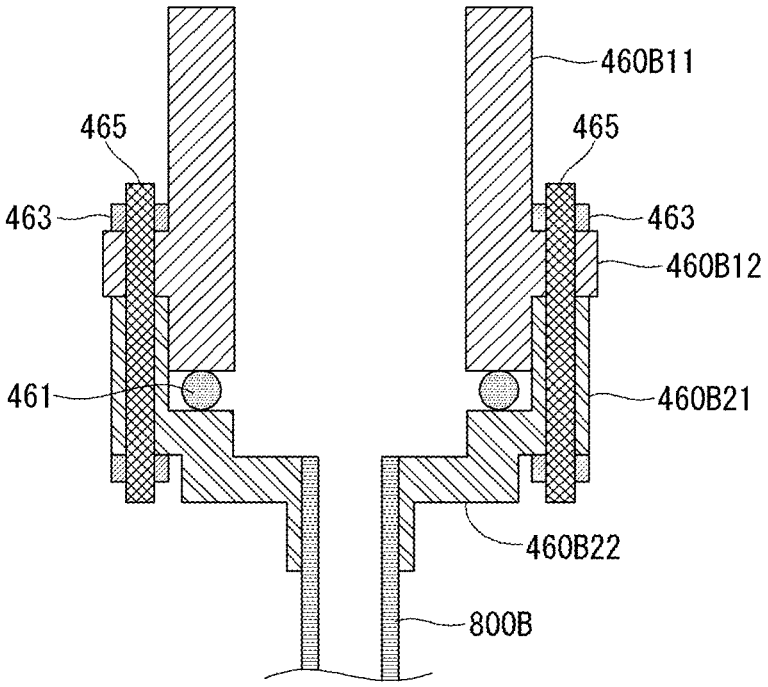
【FIG. 11】
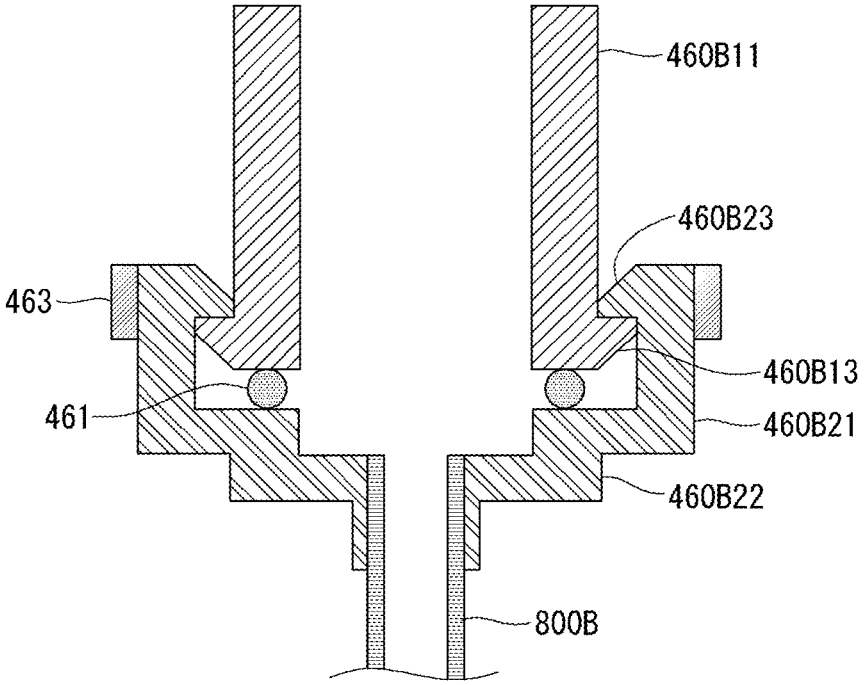

【FIG. 12】
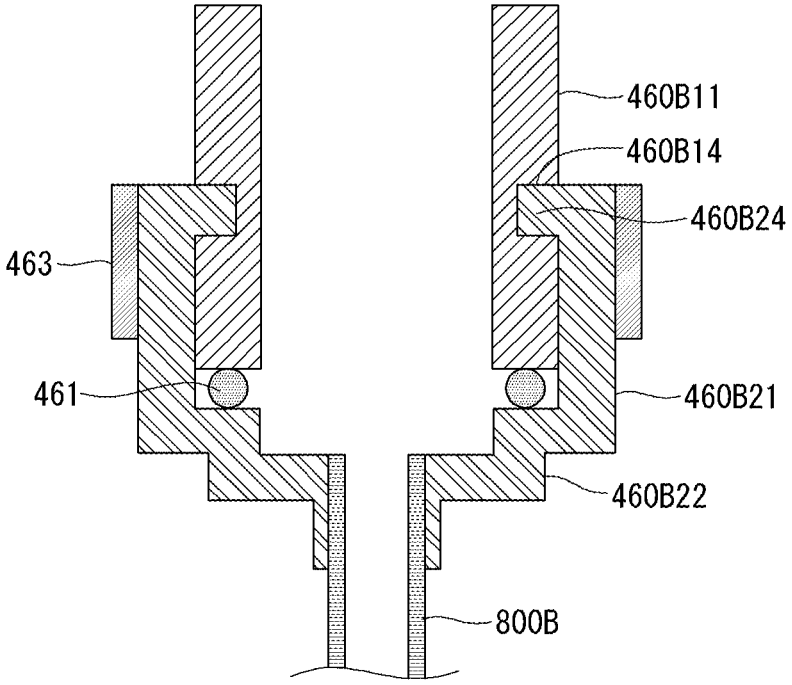
【FIG. 13】
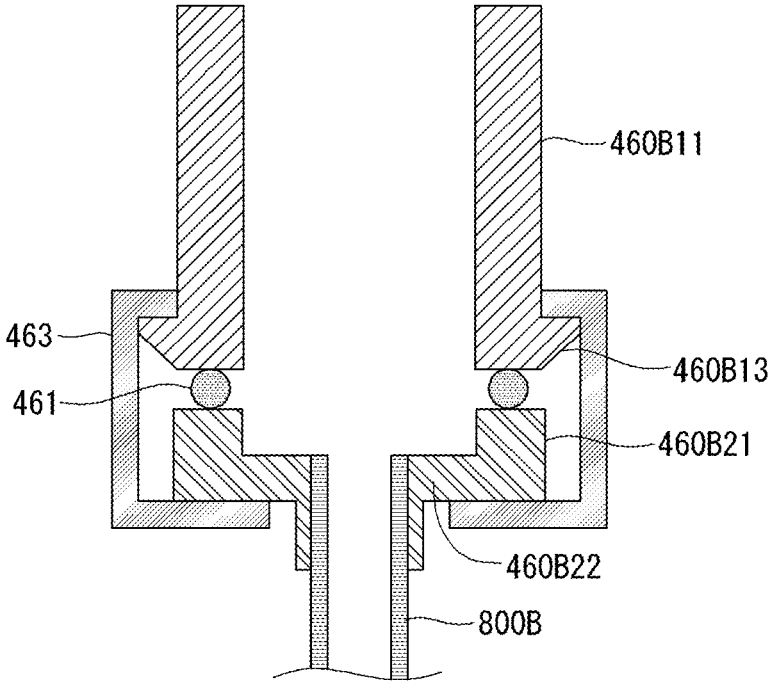

【FIG. 14】
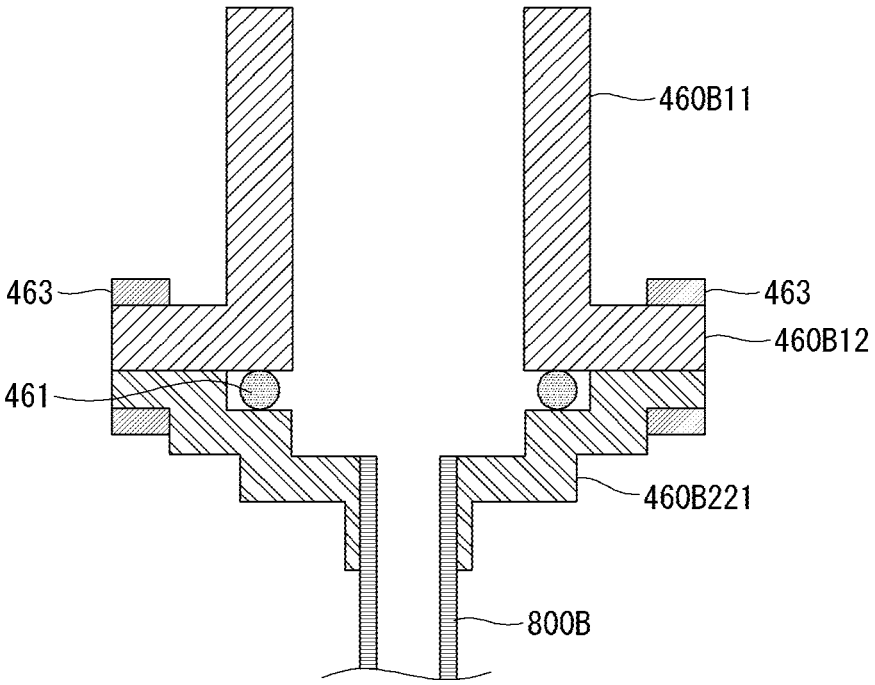

RECIPROCATING COMPRESSOR

CROSS-REFERENCE TO RELATED PATENT APPLICATIONS

This application is a U.S. National Stage Application under 35 U.S.C. § 371 of PCT Application No. PCT/KR2022/011022, filed Jul. 27, 2022, which claims priority to Korean Patent Application No. 10-2022-0072860, filed Jun. 15, 2022, whose entire disclosures are hereby incorporated by reference.

TECHNICAL FIELD

The present disclosure relates to a reciprocating compressor, and more particularly, to a reciprocating compressor including multiple discharge mufflers.

BACKGROUND ART

In general, a hermetic compressor is a compressor that includes a motor generating power inside of a hermetic container and a compression unit that operates by receiving the power of the motor.

The hermetic compressor may be classified into a reciprocating compressor, a rotary compressor, a vane compressor, a scroll compressor, or the like, based on a method of compressing a refrigerant which is a compressible fluid.

The reciprocating compressor is configured such that a crankshaft is coupled to a rotor of a motor, a connecting rod is coupled to the crankshaft, and a piston coupled to the connecting rod compresses a refrigerant while linearly reciprocating inside a cylinder.

The reciprocating compressor includes a hermetic container forming a sealed space, a motor that is provided in the hermetic container and performs a rotational motion, a compression unit that is installed on an upper side of the motor and receives a rotational force of the motor to compress a refrigerant, a suction unit that suctions the refrigerant and supplies the refrigerant to the compression unit, and a discharge unit that discharges the refrigerant compressed in the compression unit.

The discharge unit includes a discharge muffler that attenuates a discharge noise of the discharged refrigerant, a discharge pipe that is fixed to the hermetic container and is made of a metal material, and a discharge hose connecting the discharge muffler to the discharge pipe.

FIG. 1 is an exploded perspective view schematically illustrating a structure of a discharge unit of a reciprocating compressor according to a related art.

Referring to FIG. 1, in the related art, a muffler body 1100 with a plastic material and a muffler cover 1200 with a plastic material coupled to the muffler body 1100 are laser-welded to form discharge mufflers 1100 and 1200. In order to reduce vibration of a compressor body from being transmitted to a hermetic container through a discharge hose 1300, the discharge hose 1300 is formed of a flexible material, and an O-ring 1400 is installed at an end of the discharge hose 1300 and connects the discharge hose 1300 to a discharge pipe.

In FIG. 1, non-described reference numerals 1500 and 1600 denote a suction muffler, and non-described reference numeral 1700 denotes a suction discharge tank.

In addition to the structure of the discharge unit illustrated in FIG. 1, CN 108278191B, CN 100373049C, US 20050106038A1, or the like disclose a discharge unit with various structures.

However, according to the existing structure of the discharge unit, since only one discharge muffler is provided, there is a problem in that noise of various frequencies cannot be effectively reduced.

Due to the use of the discharge hose with the flexible material, there is a problem in that the discharge hose melts due to heat transferred during a process of welding a discharge pipe to the hermetic container.

In addition, since the O-ring is installed at the end of the discharge hose to connect the discharge hose to the discharge pipe, there are problems such as the O-ring being torn when the discharge hose is inserted into the discharge pipe, or the O-ring falling out during use of the compressor.

PRIOR ART DOCUMENT

Patent Document

Patent Document 1: CN 108278191B
Patent Document 2: CN 100373049C
Patent Document 3: US 20050106038A1

DISCLOSURE

Technical Problem

The present disclosure is to solve the above-described problems.

A technical object of the present disclosure is to provide a reciprocating compressor in which two or more discharge mufflers are separately arranged, a discharge hose connecting the separate discharge mufflers is formed of a flexible material, and a discharge hose connecting a discharge muffler located at a last stage to a discharge pipe is formed of a metal material.

Another technical object of the present disclosure is to provide a reciprocating compressor including a discharge hose with a metal material and a discharge hose with a flexible material.

Another technical object of the present disclosure is to provide a reciprocating compressor including a discharge unit, that can effectively block vibration generated in a compressor body, by including a discharge hose with a metal material and a discharge hose with a flexible material.

Another technical object of the present disclosure is to provide a reciprocating compressor including a discharge unit, that can securely maintain connection between a discharge hose and a discharge pipe, by including a discharge hose with a metal material and a discharge hose with a flexible material.

Another technical object of the present disclosure is to provide a reciprocating compressor including a discharge unit capable of effectively reducing noise of various frequencies.

The technical objects to be achieved by the present disclosure are not limited to those that have been described hereinabove merely by way of example, and other technical objects that are not mentioned can be clearly understood by those skilled in the art, to which the present disclosure pertains, from the following descriptions.

Technical Solution

In one aspect of the present disclosure, there is provided a reciprocating compressor in which a discharge unit includes two or more separate discharge mufflers, a discharge hose connecting a discharge muffler located at a last stage on a path, to which a refrigerant and/or gas is discharged, to a discharge pipe is formed of a metal material, and a discharge hose connecting the separate discharge mufflers is formed of a flexible material.

For example, the discharge unit may include a first discharge muffler including a first muffler body and a first muffler cover coupled to the first muffler body; a second discharge muffler including a second muffler body and a second muffler cover coupled to the second muffler body; a first discharge hose connecting the first discharge muffler and the second discharge muffler; and a second discharge hose connecting the second discharge muffler to a discharge pipe coupled to a hermetic container.

The first discharge hose connecting the first discharge muffler and the second discharge muffler is formed of a flexible material, and the second discharge hose connecting the second discharge muffler and the discharge pipe is formed of a metal material.

Since the discharge unit with the above configuration includes the first discharge muffler and the second discharge muffler that are separated from each other, the discharge unit can effectively reduce noise of a desired frequency by controlling volumes of the first and second discharge mufflers.

Since the first discharge hose connecting the first discharge muffler and the second discharge muffler is formed of the flexible material, vibration generated in a compressor body is transferred to the second discharge muffler through the first discharge hose. Therefore, the vibration generated in the compressor body can be efficiently blocked from being transferred to the hermetic container.

Since the second discharge hose connecting the second discharge muffler and the discharge pipe is formed of the metal material, the connection between the discharge hose and the discharge pipe can be securely maintained without using a sealing member such as an O-ring.

In the discharge unit with the above configuration, the first muffler body, the first muffler cover, and the second muffler body may each be formed of a plastic material, and the second muffler cover may be formed of the metal material.

The second discharge hose with the metal material and the second muffler cover with the metal material may be coupled to each other by brazing welding or may be coupled to each other by double shot molding, and the second discharge hose with the metal material and the discharge pipe with the metal material may be coupled to each other by welding.

According to the above-described configuration, the discharge hose and/or the sealing member (e.g., the O-ring) can be prevented from being damaged in a process of welding the discharge pipe to the hermetic container and/or a process of welding the second discharge hose to the discharge pipe.

The first muffler body and the first muffler cover may be coupled to each other by laser welding, and the first discharge hose with the flexible material may be coupled to each of the first muffler cover and the second muffler body by double shot molding.

According to the above-described configuration, the manufacturing process and/or coupling process of the first discharge muffler and the first discharge hose can be simplified.

The second muffler body with the plastic material and the second muffler cover with the metal material may be coupled to each other by various mechanical coupling methods.

For example, the second muffler body and the second muffler cover may be coupled to each other by a fastening member selected from among a bolt (including a nut), a screw, or a pin, coupled to each other by a clip, or coupled to each other by a structure in which they are engaged with each other.

For example, the second muffler body may include a first side wall portion, and the second muffler cover may include a second side wall portion coupled to the first side wall portion of the second muffler body, and a bottom portion that is formed integrally with the second side wall portion and is coupled to the second discharge hose with the metal material.

In this case, the first side wall portion of the second muffler body may be coupled to the inside of the second side wall portion of the second muffler cover, and the second side wall portion of the second muffler cover may be coupled to the inside of the first side wall portion of the second muffler body.

The sealing member (e.g., O-ring) or a gasket may be positioned in at least one of an area between the first side wall portion and the second side wall portion, which are connected to each other, and an area between the bottom portion and an end of the first side wall portion.

According to the above-described configuration, the refrigerant and/or gas introduced into the second discharge muffler can be prevented from leaking to the outside of the second discharge muffler through a minute gap formed between the first side wall portion of the second muffler body and the second side wall portion of the second muffler cover.

In a state in which the second muffler body and the second muffler cover are coupled, a portion of the first side wall portion may be positioned inside the second side wall portion, or a portion of the second side wall portion may be positioned inside the first side wall portion.

The second side wall portion of the second muffler cover may have an appropriate length that can securely maintain the connection between the second muffler body and the second muffler cover.

The second muffler body and the second muffler cover may be coupled to each other by a bolt that is coupled to the first side wall portion and the second side wall portion in a horizontal direction. A metal plate may be positioned on an outer surface of the second side wall portion to press the second side wall portion toward the first side wall portion.

The second side wall portion of the second muffler cover includes a hole for bolt fastening, and the first side wall portion of the second muffler body includes a groove for bolt fastening.

Accordingly, the bolt completely passes through the second side wall portion of the second muffler cover, but does not completely pass through the first side wall portion of the second muffler body. Therefore, the refrigerant and/or gas introduced into the second discharge muffler can be prevented from leaking to the outside of the second discharge muffler through a minute gap formed between the bolt and the first and second side wall portions.

Compared to when only the sealing member is used, the refrigerant and/or gas introduced into the second discharge muffler can be more efficiently prevented from leaking to the outside of the second discharge muffler through the minute gap formed between the first side wall portion of the second muffler body and the second side wall portion of the second muffler cover.

Since the bolt are coupled to the first side wall portion and the second side wall portion in the horizontal direction, workability can be improved when the bolt is fastened.

For another example, the second muffler body may further include a flange portion that protrudes outward from the first side wall portion and is placed on an end of the second side wall portion. The second muffler body and the second muffler cover may be coupled to each other by a bolt that is coupled to the flange portion of the second muffler body and the second side wall portion of the second muffler cover in an upward and downward direction.

According to the above-described configuration, since the second muffler body and the second muffler cover are coupled until the flange portion of the second muffler body is placed on the end of the second side wall portion of the second muffler cover, the degree of coupling of the second muffler body and the second muffler cover can be reliably controlled.

Since the first side wall portion of the second muffler body does not need to include a groove for bolt fastening, a strength of the second muffler body can be maintained well.

The refrigerant and/or gas introduced into the second discharge muffler can be more reliably prevented from leaking to the outside of the second discharge muffler through the minute gap formed between the first side wall portion of the second muffler body and the second side wall portion of the second muffler cover.

Since the bolt are coupled to the flange portion of the second muffler body and the second side wall portion in the upward and downward direction, workability can be improved when the bolt is fastened.

For another example, a metal plate is positioned on an outer surface of the bottom portion of the second muffler body and an outer surface of the second side wall portion of the second muffler cover to press the bottom portion of the second muffler body and the second side wall portion of the second muffler cover toward each other.

According to the above-described configuration, the coupling between the flange portion of the second muffler body and the second side wall portion of the second muffler cover can be more reliably maintained, compared to when the flange portion of the second muffler body and the second side wall portion of the second muffler cover are fastened only by the bolt.

For another example, a first clip portion may be formed at the end of the first side wall portion, and a second clip portion may be formed at an end of the second side wall portion. The second muffler body and the second muffler cover may be coupled to each other by the first clip portion and the second clip portion.

According to the above-described configuration, a coupling operation between the second muffler body and the second muffler cover can be easily performed.

A metal plate may be positioned on an outer surface of the second side wall portion to press the second side wall portion toward the first side wall portion.

According to the above-described configuration, the coupling between the first side wall portion of the second muffler body and the second side wall portion of the second muffler cover can be more reliably maintained, compared to when the first side wall portion of the second muffler body and the second side wall portion of the second muffler cover are fastened only by the first and second clip portions.

For another example, a groove may be formed in an outer surface of the first side wall portion, and a protrusion inserted into the groove may be formed at an end of the second side wall portion. The second muffler body and the second muffler cover may be coupled to each other by the protrusion inserted into the groove.

According to the above-described configuration, a coupling operation between the second muffler body and the second muffler cover can be easily performed.

A metal plate may be positioned on an outer surface of the second side wall portion to press the second side wall portion toward the first side wall portion.

According to the above-described configuration, the coupling between the first side wall portion of the second muffler body and the second side wall portion of the second muffler cover can be more reliably maintained, compared to when the first side wall portion of the second muffler body and the second side wall portion of the second muffler cover are fastened only by an interaction of the protrusion and the groove.

For another example, the second muffler body may further include a first clip portion positioned at an end of the first side wall portion. The second muffler body and the second muffler cover may be coupled to each other by a metal plate that presses the first clip portion of the second muffler body and the bottom portion of the second muffler cover toward each other.

A sealing member may be positioned between the first clip portion and the bottom portion.

According to the above-described configuration, the coupling between the second muffler body and the second muffler cover can be reliably maintained.

For another example, the second muffler body may include a first side wall portion and a bottom portion that is formed integrally with the first side wall portion, and the second muffler cover may include a stepwise bottom portion coupled to the second discharge hose with the metal material. The second muffler body and the second muffler cover may be coupled to each other by a metal plate that presses the bottom portion of the second muffler body and the stepwise bottom portion of the second muffler cover toward each other.

A sealing member may be positioned between the bottom portion of the second muffler body and the stepwise bottom portion of the second muffler cover.

According to the above-described configuration, the coupling between the second muffler body and the second muffler cover can be reliably maintained.

Advantageous Effects

According to a reciprocating compressor according to the present disclosure, since a discharge unit includes a plurality of discharge mufflers that are separated from each other, the discharge unit can effectively reduce noise of a desired frequency by controlling a volume of each of the separated discharge mufflers.

In addition, since discharge hoses connecting the separated discharge mufflers are formed of a flexible material, and a discharge hose connecting a discharge muffler located at a last stage on a discharge path of a refrigerant and/or gas to a discharge pipe is formed of a metal material, embodiments can effectively block vibration generated in a compressor body and securely maintain the connection between the discharge hose and the discharge pipe.

Effects that could be achieved with the present disclosure are not limited to those that have been described hereinabove merely by way of example, and other effects and advantages of the present disclosure will be more clearly understood from the following description by a person skilled in the art to which the present disclosure pertains.

DESCRIPTION OF DRAWINGS

The accompanying drawings, which are included to provide a further understanding of the present disclosure and constitute a part of the detailed description, illustrate embodiments of the present disclosure and serve to explain technical features of the present disclosure together with the description.

FIG. 1 is an exploded perspective view schematically illustrating a discharge unit of a reciprocating compressor according to a related art.

FIG. 2 is an appearance perspective view of a reciprocating compressor according to an embodiment of the present disclosure.

FIG. 3 is an exploded perspective view of a reciprocating compressor according to an embodiment of the present disclosure.

FIG. 4 is a cross-sectional view of a reciprocating compressor according to an embodiment of the present disclosure.

FIG. 5 illustrates a partial configuration of a reciprocating compressor according to an embodiment of the present disclosure.

FIG. 6 is a front perspective view illustrating a connection of a muffler assembly and a discharge hose according to an embodiment of the present disclosure.

FIG. 7 is a rear perspective view illustrating a connection of a muffler assembly and a discharge hose according to an embodiment of the present disclosure.

FIG. 8 is a cross-sectional view illustrating a coupling of a second muffler body and a second muffler cover according to a first embodiment of the present disclosure.

FIG. 9 is a cross-sectional view illustrating a coupling of a second muffler body and a second muffler cover according to a second embodiment of the present disclosure.

FIG. 10 is a cross-sectional view illustrating a coupling of a second muffler body and a second muffler cover according to a third embodiment of the present disclosure.

FIG. 11 is a cross-sectional view illustrating a coupling of a second muffler body and a second muffler cover according to a fourth embodiment of the present disclosure.

FIG. 12 is a cross-sectional view illustrating a coupling of a second muffler body and a second muffler cover according to a fifth embodiment of the present disclosure.

FIG. 13 is a cross-sectional view illustrating a coupling of a second muffler body and a second muffler cover according to a sixth embodiment of the present disclosure.

FIG. 14 is a cross-sectional view illustrating a coupling of a second muffler body and a second muffler cover according to a seventh embodiment of the present disclosure.

MODE FOR INVENTION

Reference will now be made in detail to embodiments of the present disclosure, examples of which are illustrated in the accompanying drawings. Wherever possible, the same reference numbers will be used throughout the drawings to refer to the same or like parts.

In general, a suffix such as "assembly" and "unit" may be used to refer to elements or components. Use of such a suffix herein is merely intended to facilitate description of the present disclosure, and the suffix itself is not intended to give any special meaning or function.

It will be noted that a detailed description of known arts will be omitted if it is determined that the detailed description of the known arts can obscure embodiments of the present disclosure.

The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

The terms including an ordinal number such as first, second, etc. may be used to describe various components, but the components are not limited by such terms. The terms are used only for the purpose of distinguishing one component from other components.

When any component is described as "being coupled to" or "being assembled with" other component, this should be understood to mean that another component may exist between them although any component may be directly coupled to or assembled with the other component.

On the other hand, when any component is described as "being directly coupled to" or "being assembled with" other component, this should be understood to mean that no component exists between them.

A singular expression can include a plural expression as long as it does not have an apparently different meaning in context.

In embodiments of the present disclosure, terms "include or comprise" or "have" should be understood to be intended to designate that illustrated features, numbers, steps, operations, components, parts or combinations thereof are present and not to preclude the existence of one or more other features, numbers, steps, operations, components, parts or combinations thereof, or the possibility of the addition thereof.

Reference will now be made in detail to embodiments of the present disclosure, examples of which are illustrated in the accompanying drawings. Wherever possible, the same reference numbers will be used throughout the drawings to refer to the same or like parts.

A reciprocating compressor according to embodiments of the present disclosure is described in detail below with reference to the accompanying drawings.

FIG. 2 is a perspective view of a reciprocating compressor according to an embodiment of the present disclosure. FIG. 3 is an exploded perspective view of a reciprocating compressor according to an embodiment of the present disclosure. FIG. 4 is a cross-sectional view of a reciprocating compressor according to an embodiment of the present disclosure.

Referring to FIGS. 2 to 4, a reciprocating compressor 10 according to an embodiment of the present disclosure includes a hermetic container 100 forming an appearance, a motor 200 that is located in an internal space of the hermetic container 100 and provides a drive force, a compression unit 300 that receives the drive force from the motor 200 and compresses a refrigerant through a linear reciprocating motion, and a suction discharge unit 400 that suctions the refrigerant for refrigerant compression of the compression unit 300 and discharges the refrigerant compressed from the compression unit 300.

The hermetic container 100 forms a sealed space therein and accommodates various components of the compressor 10 in the sealed space. The hermetic container 100 is made of a metal material and includes a lower hermetic container 110 and an upper hermetic container 160.

The lower hermetic container 110 has a substantially hemispherical shape, and the lower hermetic container 110 and the upper hermetic container 160 form an accommodation space that accommodates various components forming the motor 200, the compression unit 300, the suction discharge unit 400, and the compressor 10.

The lower hermetic container 110 may be referred to as a "compressor body", and the upper hermetic container 160 may be referred to as a "compressor cover".

The lower hermetic container 110 includes a suction pipe 120, a discharge pipe 130, a process pipe 140, and a power supply unit (not shown).

A refrigerant flows into the hermetic container 100 through the suction pipe 120, which is mounted to pass through the lower hermetic container 110.

The suction pipe 120 may be separately mounted on the lower hermetic container 110 or formed integrally with the lower hermetic container 110.

The discharge pipe 130 is made of a metal material, discharges the refrigerant compressed in the hermetic container 100, and is mounted to pass through the lower hermetic container 110.

The discharge pipe 130 may be separately mounted on the lower hermetic container 110 by welding or formed integrally with the lower hermetic container 110.

A discharge hose 800 of the suction discharge unit 400 described below is connected to the discharge pipe 130. The refrigerant flowing into the suction pipe 120 and compressed through the compression unit 300 may be discharged to the discharge pipe 130 via the discharge hose 800 of the suction discharge unit 400.

The process pipe 140 is a device provided to charge a refrigerant into the hermetic container 100 after sealing the inside of the hermetic container 100. The process pipe 140 may be mounted to pass through the lower hermetic container 110 together with the suction pipe 120 and the discharge pipe 130.

The upper hermetic container 160 forms the accommodation space together with the lower hermetic container 110 and is formed in a substantially hemispherical shape like the lower hermetic container 110. The upper hermetic container 160 packages the lower hermetic container 110 on the lower hermetic container 110 to form the sealed space therein.

The motor 200 includes stators 210 and 220, an insulator 230, a rotor 240, and a rotational shaft 250.

The stators 210 and 220 are fixed components during the driving of the motor 200, and include a stator core 210 and a stator coil 220.

The stator core 210 may be made of a metal material and may have a substantially cylindrical shape with an inner hollow.

The stator coil 220 is mounted inside the stator core 210. When power is applied from the outside, the stator coil 220 generates an electromagnetic force to perform an electromagnetic interaction with the stator core 210 and the rotor 240. Through this, the motor 200 may generate the drive force for reciprocating motion of the compression unit 300.

The insulator 230 is located between the stator core 210 and the stator coil 220 and prevents a direct contact between the stator core 210 and the stator coil 220.

When the stator coil 220 is in direct contact with the stator core 210, as generation of the electromagnetic force from the stator coil 220 may be hindered, the insulator 230 prevents the direct contact.

The insulator 230 may separate the stator core 210 and the stator coil 220 by a predetermined distance from each other.

The rotor 240 may be rotatably provided inside the stator coil 220 and may be installed inside the insulator 230. The rotor 240 includes a magnet.

When the power is supplied from the outside, the rotor 240 rotates through the electromagnetic interaction with the stator core 210 and the stator coil 220.

A rotational force resulting from rotation of the rotor 240 acts as a drive force capable of driving the compression unit 200.

The rotational shaft 250 may be installed in the rotor 240, mounted to pass through the rotor 240 along an upward and downward direction, and rotate together with the rotor 240. The rotational shaft 250 is connected to a connecting rod 340 described below and transmits the rotational force generated from the rotor 240 to the compression unit 300.

The rotational shaft 250 includes a base shaft 252, a rotational plate 254, and an eccentric shaft 256.

The base shaft 252 is mounted in the rotor 240 in the upward and downward direction (Z-axis direction) or a longitudinal direction. When the rotor 240 rotates, the base shaft 252 may rotate together with the rotor 240.

The rotational plate 254 may be installed on one side of the base shaft 252 and may be rotatably mounted on a rotational plate seating part 320 of a cylinder block 310.

The eccentric shaft 256 protrudes upward from an upper surface of the rotational plate 254.

More specifically, the eccentric shaft 256 protrudes from the rotational plate 254 at an eccentric position from an axial center of the base shaft 252 and rotates eccentrically when the rotational plate 254 rotates.

The connecting rod 340 is mounted on the eccentric shaft 256. According to an eccentric rotation of the eccentric shaft 256, the connecting rod 340 linearly reciprocates in a forward and backward direction (X-axis direction).

The compression unit 300 includes the cylinder block 310, the connecting rod 340, a piston 350, and a piston pin 370.

The cylinder block 310 is provided on the motor 200, more specifically, on the rotor 240 and is mounted inside the hermetic container 100. The cylinder block 310 includes the rotational plate seating part 320 and a cylinder 330.

The rotational plate seating part 320 is formed at a bottom of the cylinder block 310 and rotatably accommodates the rotational plate 254. A shaft opening 322 through which the rotational shaft 250 passes is formed in the rotational plate seating part 320.

The cylinder 330 is provided at the front of the cylinder block 310 and accommodates the piston 350 described below. The piston 350 reciprocates in the forward and backward direction (X-axis direction), and a compression space C capable of compressing the refrigerant is formed inside the cylinder 330.

The cylinder 330 may be made of an aluminum material. For example, the cylinder 330 may be made of aluminum or aluminum alloy.

A magnetic flux generated from the rotor 240 is not transmitted to the cylinder 330 due to the aluminum material, which is non-magnetic. Hence, as the magnetic flux generated from the rotor 240 is not transmitted to the cylinder 330, the magnetic flux can be prevented from leaking outside of the cylinder 330.

The connecting rod 340 is a device that transmits the drive force provided from the motor 200 to the piston 350, and converts a rotational motion of the rotational shaft 250 into a linear reciprocating motion.

When the rotational shaft 250 rotates, the connecting rod 340 linearly reciprocates in the forward and backward direction (X-axis direction). The connecting rod 340 may be made of a sintered alloy material.

The piston 350 is a device that compresses the refrigerant. The piston 350 is accommodated in the cylinder 330 so as to be able to reciprocate in the forward and backward direction (X-axis direction). The piston 350 is connected to the connecting rod 340.

The piston 350 linearly reciprocates in the cylinder 330 based on the movement of the connecting rod 340. As the piston 350 reciprocates, the refrigerant flowing from the suction pipe 120 may be compressed in the cylinder 330.

The piston 350 may be made of an aluminum material, for example, aluminum or an aluminum alloy in the same manner as the cylinder 330.

Therefore, the magnetic flux generated from the rotor 240 can be prevented from leaking to the outside through the piston 350.

In addition, the piston 350 may be made of the same material as the cylinder 330 and have substantially a same thermal expansion coefficient as the cylinder 330.

As the piston 350 and the cylinder 330 have substantially the same thermal expansion coefficient, when the compressor 10 is driven, the piston 350 is thermally deformed by substantially a same amount as the cylinder 330 in an internal environment of the hermetic container 100 at a high temperature (generally, about 100° C.). Therefore, when the piston 350 reciprocates in the cylinder 330, interference between the piston 350 and the cylinder 330 can be prevented from occurring.

The piston pin 370 couples the piston 350 to the connecting rod 340. That is, the piston pin 370 connects the piston 350 to the connecting rod 340 by penetrating the piston 350 and the connecting rod 340 in the upward and downward direction (Z-axis direction).

The suction discharge unit 400 includes a muffler assembly 410, a valve assembly 480, discharge hoses 800A and 800B, a plurality of gaskets 485 and 488, an elastic member 490, and a clamp 492.

The muffler assembly 410 transfers the refrigerant suctioned from the suction pipe 120 to an inside of the cylinder 330, and the refrigerant compressed in the compression space C of the cylinder 330 is transferred to the discharge pipe 130.

That is, the muffler assembly 410 includes a suction space S that accommodates the refrigerant suctioned from the suction pipe 120, and a discharge space D that accommodates the refrigerant compressed in the compression space C of the cylinder 330.

The refrigerant suctioned from the suction pipe 120 is introduced into the suction space S of a suction discharge tank 426 via suction mufflers 430 and 420 described below. The refrigerant compressed in the cylinder 330 passes through a discharge muffler described below via the discharge space D of the suction discharge tank 426 and is discharged to the outside of the compressor 10 through the discharge hoses 800A and 800B.

The valve assembly 480 guides the refrigerant of the suction space S to the inside of the cylinder 330 or guides the refrigerant compressed in the cylinder 330 to the discharge space D.

That is, a discharge valve 483 is arranged on a front surface of the valve assembly 480 to open and close so that the refrigerant compressed in the compression space C is discharged to the discharge space D, and a suction valve 481 is arranged on a rear surface of the valve assembly 480 to open and close so that the refrigerant in the suction space S is discharged to the compression space C of the cylinder 330.

That is, the discharge valve 483 is provided on the front surface of the valve assembly 480, and the suction valve 481 is provided on the rear surface of the valve assembly 420.

Operation of the discharge valve 483 and the suction valve 481 is described below.

When the refrigerant compressed in the compression space C of the cylinder 330 is discharged, the discharge valve 483 is opened and the suction valve 481 is closed. Hence, the refrigerant compressed in the cylinder 330 may flow into the discharge space D without flowing into the suction space S.

Conversely, when the refrigerant flowing into the suction space S is suctioned into the cylinder 330, the discharge valve 483 is closed and the suction valve 481 is opened. Hence, the refrigerant in the suction space S may flow into the cylinder 330 without flowing into the discharge space D.

The discharge hoses 800A and 800B are a device that transfers the compressed refrigerant accommodated in the discharge space D to the discharge pipe 130. The muffler assembly 410 includes separately and independently two discharge mufflers 460A and 460B. The discharge hose 800A connects the two discharge mufflers 460A and 460B, and the discharge hose 800B connects the discharge muffler 460B to the discharge pipe 130

The plurality of gaskets 485 and 488 are a device that prevents the refrigerant from leaking, and are mounted on a side and another side of the valve assembly 480, respectively.

Specifically, the plurality of gaskets 485 and 488 include a first gasket 485 and a second gasket 488. The first gasket 485 is mounted in front of the valve assembly 480, and the second gasket 488 is mounted in rear of the valve assembly 480.

The elastic member 490 supports the muffler assembly 410 when the compressor 10 is driven, and is mounted in front of the muffler assembly 410. The elastic member 490 may include a Belleville spring.

The clamp 492 fixes the valve assembly 480, the first gasket 485, the second gasket 488, and the elastic member 490 to the muffler assembly 410. The clamp 492 may be formed in a substantially triangular shape and mounted to the muffler assembly 410 through a fastening means, such as a screw member.

The compressor 10 further includes a plurality of damper members 500, 550, 600, and 650 and a balance weight 700.

The plurality of damper members 500, 550, 600, and 650 dampen vibration, etc. of internal structures generated when the compressor 10 is driven. The plurality of damper members 500, 550, 600, and 650 include a front damper 500, a rear damper 550, and lower dampers 600 and 650.

The front damper 500 dampens vibration of the suction discharge unit 400 and may be made of a rubber material. The front damper 500 may be coupled to a front upper portion of the cylinder block 310 through a fastening means coupled to the clamp 492.

The rear damper 550 dampens vibration of the compression unit 300 and is mounted on a rear upper portion of the cylinder block 310. The rear damper 550 may be made of a rubber material.

The lower dampers 600 and 650 dampen vibration of the motor 200 and may include a plurality of dampers. For example, the plurality of lower dampers 600 and 650 may include a front lower damper 600 and a rear lower damper 650.

The front lower damper 600 dampens vibration on a front side of the motor 200 and is mounted on a front lower side of the stator core 210. The rear lower damper 650 dampens vibration on a rear side of the motor 200 and is mounted on a rear lower side of the stator core 210.

The balance weight 700 is a device that controls rotational vibration when the rotational shaft 250 of the motor 200 rotates. The balance weight 700 is coupled to the eccentric shaft 256 of the rotational shaft 250 at an upper side of the connecting rod 340.

Configurations of the muffler assembly 410 and the discharge hoses 800A and 800B are described in detail below.

FIG. 5 illustrates a partial configuration of a reciprocating compressor according to an embodiment of the present disclosure. FIG. 6 is a front perspective view illustrating a connection of a muffler assembly and a discharge hose according to an embodiment of the present disclosure.

FIG. 7 is a rear perspective view illustrating a connection of a muffler assembly and a discharge hose according to an embodiment of the present disclosure. FIG. 8 is a cross-sectional view illustrating a coupling of a second muffler body and a second muffler cover according to a first embodiment of the present disclosure.

Before describing specific embodiments of the present disclosure, the features of the reciprocating compressor according to the present disclosure are briefly described. The reciprocating compressor according to the present disclosure includes the plurality of discharge mufflers that are separated from each other, the discharge hoses connecting the discharge mufflers are formed of a flexible material, and the discharge hose connecting the discharge muffler located at the last stage on a discharge path of the refrigerant and/or gas to the discharge pipe is formed of a metal material.

Since the discharge unit with the above configuration includes the plurality of discharge mufflers that are separated from each other, the discharge unit can effectively reduce noise of a desired frequency by controlling a volume of each of the discharge mufflers.

Since the discharge hoses connecting the discharge mufflers are formed of the flexible material, and the discharge hose connecting the discharge muffler located at the last stage on the discharge path of the refrigerant and/or gas to the discharge pipe is formed of the metal material, embodiments can effectively block vibration generated in the compressor body and securely maintain the connection between the discharge hose and the discharge pipe.

The muffler assembly with various structures included in the reciprocating compressor according to the present disclosure is described below.

Referring to FIGS. 5 to 8, the muffler assembly 410 according to an embodiment of the present disclosure includes a first assembly part 430, a second assembly part 420, a third assembly part 460A1, and a fourth assembly part 460A2.

The first assembly part 430 includes a suction hole 432 that communicates with the suction pipe 120. The suction hole 432 is positioned adjacent to an inside of a point of the lower hermetic container 110 to which the suction pipe 120 is coupled. An inner pipe 450 is installed inside the first assembly part 430. For example, the inner pipe 450 may include a substantially cylindrical pipe.

A first fixing part 441 fixing the inner pipe 450 is installed inside the first assembly part 430. A through hole 442 corresponding to the suction hole 432 is formed in the first fixing part 441. Therefore, in a state in which the first fixing part 441 is installed inside the first assembly part 430, the suction hole 432 and the through hole 442 may be aligned with each other.

The inner pipe 450 includes a first coupling part 454 coupled to the first fixing part 441.

The inner pipe 450 may extend upward from the first assembly part 430 and may be coupled to the second assembly part 420. The second assembly part 420 includes a second fixing part coupled to the inner pipe 450. The inner pipe 450 includes a second coupling part 455 coupled to the second fixing part.

The second assembly part 420 is coupled to an upper side of the first assembly part 430. At least a portion of the inner pipe 450 may be positioned inside the first assembly part 430, and a remaining portion may be positioned inside the second assembly part 420.

When the first assembly part 430 and the second assembly part 420 are coupled, a suction passage through which the refrigerant suctioned into the compressor 10 flows toward the cylinder 330 is formed inside the first and second assembly parts 430 and 420. Thus, the first and second assembly parts 430 and 420 may be collectively referred to as a "suction muffler".

The third assembly part 460A1 is spaced apart from one side of the second assembly part 420. The suction discharge tank 426 that forms the suction space S and the discharge space D is installed between the second assembly part 420 and the third assembly part 460A1.

The suction discharge tank 426 includes a partition 427 that partitions an internal space of the suction discharge tank 426 into the suction space S and the discharge space D. The valve assembly 480 may be installed on or at one side of the suction discharge tank 426.

The suction space S may be shielded by the suction valve 481, and the discharge space D may be shielded by the discharge valve 483.

The fourth assembly part 460A2 is coupled to a lower side of the third assembly part 460A1. When the third assembly part 460A1 and the fourth assembly part 460A2 are coupled, a discharge passage through which the refrigerant discharged from the cylinder 330 flows toward the discharge pipe 130 is formed inside the third and fourth assembly parts 460A1 and 460A2.

Thus, the third and fourth assembly parts 460A1 and 460A2 may be collectively referred to as a "first discharge muffler".

The third assembly 460A1 may be referred to as a "first muffler body" forming the first discharge muffler, and the fourth assembly 460A2 may be referred to as a "first muffler cover" that is coupled to the first muffler body to form the first discharge muffler.

Therefore, the suction mufflers 420 and 430 and the first discharge mufflers 460A1 and 460A2 are positioned spaced apart from each other on both sides of the suction discharge tank 426 with the suction discharge tank 426 interposed therebetween.

A plurality of partitions may be positioned in an internal space of the first discharge mufflers 460A1 and 460A2 to form the internal space into a plurality of damping spaces. The number of partitions may be variously changed.

In the present disclosure, second discharge mufflers 460B1 and 460B2 are positioned below the first discharge mufflers 460A1 and 460A2.

Therefore, the reciprocating compressor according to the present disclosure includes a discharge muffler including the first discharge mufflers 460A1 and 460A2 and the second discharge mufflers 460B1 and 460B2 that are separated from each other.

The following describes that the reciprocating compressor includes two discharge mufflers, as an example, but the more discharge mufflers may be used if necessary.

The second discharge mufflers 460B1 and 460B2 may include a fifth assembly part 460B1 and a sixth assembly part 460B2.

The fifth assembly part 460B1 may be referred to as a "second muffler body" of the second discharge muffler, and the sixth assembly 460B2 may be referred to as a "second muffler cover" of the second discharge muffler.

In the discharge muffler with the above configuration, the first muffler body 460A1, the first muffler cover 460A2, and the second muffler body 460B1 each may be formed of a plastic material, and the second muffler cover 460B2 may be formed of a metal material.

Internal volumes of the first discharge mufflers 460A1 and 460A2 and the second discharge mufflers 460B1 and 460B2 may be variously formed so as to reduce a discharge pulsation noise of a specific frequency.

For example, a volume of the first discharge mufflers 460A1 and 460A2 may be greater than a volume of the second discharge mufflers 460B1 and 460B2.

The first discharge mufflers 460A1 and 460A2 and the second discharge mufflers 460B1 and 460B2 are connected by the first discharge hose 800A with a flexible material, and the second discharge mufflers 460B1 and 460B2 and the discharge pipe 130 are connected by the second discharge hose 800B with a metal material.

The first discharge hose 800A is formed of the flexible material so as to reduce the vibration generated in the compressor body from being transmitted to the hermetic container.

A reason why the second discharge hose 800B is formed of the metal material is to solve a problem occurring in an existing reciprocating compressor, in which a discharge hose and a discharge pipe are connected by installing an O-ring at an end of the discharge hose, by welding the second discharge hose 800B to the discharge pipe 130.

Separating the first discharge mufflers 460A1 and 460A2 into the third assembly part 460A1 with the plastic material and the fourth assembly part 460A2 with the plastic material is to manufacture the first discharge hose 800A with the flexible material and the fourth assembly part 460A2 by double shot molding.

According to the above-described configuration, the manufacturing process and/or coupling process of the first discharge muffler and the first discharge hose can be simplified.

Separating the second discharge mufflers 460B1 and 460B2 into the fifth assembly part 460B1 with the plastic material and the sixth assembly part 460B2 with the metal material is to manufacture the first discharge hose 800A with the flexible material and the fifth assembly part 460B1 with the plastic material by double injection molding, or to manufacture the second discharge hose 800B with the metal material and the sixth assembly part 460B2 with the metal material by double injection molding, or to couple the second discharge hose 800B with the metal material to the sixth assembly part 460B2 with the metal material by brazing.

The third assembly part 460A1 with the plastic material and the fourth assembly part 460A2 with the plastic material forming the first discharge mufflers 460A1 and 460A2 may be coupled by laser welding.

The fifth assembly part 460B1 with the plastic material and the sixth assembly part 460B2 with the metal material forming the second discharge mufflers 460B1 and 460B2 may be coupled by a physical coupling method or laser welding.

The second discharge hose 800B may be coupled to the discharge pipe 130 by welding.

According to the above-described configuration, the second discharge muffler can be fixed and supported by the second discharge hose.

A portion of the second discharge hose 800B may be supported by a hose fixing part 553. The hose fixing part 553 may be coupled to the rear damper 550 and configured to clamp the second discharge hose 800B.

For example, the hose fixing part 553 may have a tong shape and may surround at least a portion of an outer perimeter surface of the second discharge hose 800B. By the hose fixing part 553, the second discharge hose 800B may be guided to be positioned in a state of being spaced apart from an inner surface of the hermetic container 100.

The discharge pipe 130 passes through the lower hermetic container 110 and extends to the inside of the lower hermetic container 110, and the second discharge hose 800B is coupled directly to the discharge pipe 130 by welding.

In order to facilitate the connection between the discharge pipe 130 and the second discharge hose 800B, the discharge pipe 130 may pass through the lower hermetic container 110, be bent, and extend upward.

The discharge pipe 130 may be made of a metal material, for example, copper (Cu).

The fifth assembly part 460B1 with the plastic material and the sixth assembly part 460B2 with the metal material may be coupled to each other by various methods.

For example, the fifth assembly part and the sixth assembly part may be coupled to each other by a fastening member selected from among a bolt (including a nut), a screw, or a pin, coupled to each other by a clip, or coupled to each other by a structure in which they are engaged with each other.

A coupling structure of a fifth assembly part 640B1 and a sixth assembly part 640B2 forming second discharge mufflers 640B1 and 640B2 is described below with reference to the accompanying drawings.

FIG. 8 is a cross-sectional view illustrating a coupling of a second muffler body (fifth assembly part) and a second muffler cover (sixth assembly part) according to the first embodiment of the present disclosure.

In the present embodiment, the fifth assembly part 460B1 includes a first side wall portion 460B11, and the sixth assembly part 460B2 includes a second side wall portion 460B21 coupled to the first side wall portion 460B11 of the fifth assembly part 460B1, and a bottom portion 460B22 which is formed integrally with the second side wall portion 460B21 and is coupled to the second discharge hose 800B with the metal material.

A sealing member 461 is positioned in at least one of an area between the first side wall portion 460B11 and the second side wall portion 460B21 and an area between the bottom portion 460B22 and an end of the first side wall portion 460B11.

The sealing member may be formed as an O-ring or a gasket.

The second side wall portion 460B21 of the sixth assembly part 460B2 may have an appropriate length that can securely maintain the connection between the fifth assembly part 460B1 and the sixth assembly part 460B2.

FIG. 8 illustrates an example in which the sealing members 461 are respectively positioned between the first side wall portion 460B11 and the second side wall portion 460B21 and between the bottom portion 460B22 and the end of the first side wall portion 460B11.

However, the sealing member 461 may be positioned only between the first side wall portion 460B11 and the second side wall portion 460B21, or positioned only between the bottom portion 460B22 and the end of the first side wall portion 460B11.

In a state in which the fifth assembly part 460B1 and the sixth assembly part 460B2 are coupled, a portion of the first side wall portion 460B11 is positioned inside the second side wall portion 460B21.

Alternatively, a portion of the second side wall portion 460B21 may be positioned inside the first side wall portion 460B11.

The first side wall portion 460B11 and the second side wall portion 460B21 are coupled by bonding or ultrasonic welding.

According to the above-described configuration, the refrigerant and/or gas introduced into the second discharge muffler can be prevented from leaking to the outside of the second discharge muffler through a minute gap formed between the first side wall portion of the second muffler body and the second side wall portion of the second muffler cover.

In order to increase a coupling strength between the fifth assembly part 460B1 and the sixth assembly part 460B2, a metal plate 463 is positioned on an outer surface of the second side wall portion 460B21 to press the second side wall portion 460B21 toward the first side wall portion 460B11. However, the metal plate 463 may not be provided.

FIG. 9 is a cross-sectional view illustrating a coupling of a second muffler body (fifth assembly part) and a second muffler cover (sixth assembly part) according to a second embodiment of the present disclosure.

In describing the following embodiments, the same components as those in the first embodiment described above with reference to FIG. 8 are given the same reference numerals, and a detailed description thereof is omitted.

Referring to FIG. 9, a fifth assembly part 460B1 and a sixth assembly part 460B2 are coupled to each other by a bolt 465 that is coupled to a first side wall portion 460B11 and a second side wall portion 460B21 in a horizontal direction (X-axis direction and/or Y-axis direction).

When the fifth assembly part 460B1 and the sixth assembly part 460B2 are fastened to each other using the bolt 465, a refrigerant and/or gas introduced into a second discharge muffler can be more efficiently prevented from leaking to the outside of the second discharge muffler, compared to when they are fastened using only the sealing member 461.

Since the bolt 465 are coupled to the first side wall portion 460B11 and the second side wall portion 460B21 in the horizontal direction, workability can be improved when the bolt 465 is fastened.

In this instance, the second side wall portion 460B21 of the sixth assembly part 460B2 includes a hole for bolt fastening, and the first side wall portion 460B11 of the fifth assembly part 460B1 includes a groove for bolt fastening.

Therefore, the bolt 465 completely passes through the second side wall portion 460B21 of the sixth assembly part 460B2, but does not pass through the first side wall portion 460B11 of the fifth assembly part 460B1.

Accordingly, the refrigerant and/or gas introduced into the second discharge muffler can be prevented from leaking to the outside of the second discharge muffler through a minute gap between the bolt 465 and the first and second side wall portions 460B11 and 460B211

In order to increase a coupling strength between the fifth assembly part 460B1 and the sixth assembly part 460B2, a metal plate 463 is positioned on an outer surface of the second side wall portion 460B21 to press the second side wall portion 460B21 toward the first side wall portion 460B11. However, the metal plate 463 may not be provided.

FIG. 10 is a cross-sectional view illustrating a coupling of a second muffler body (fifth assembly part) and a second muffler cover (sixth assembly part) according to a third embodiment of the present disclosure.

A fifth assembly part 460B1 includes a flange portion 460B12 that protrudes outward from a first side wall portion 460B11 and is placed on an end of a second side wall portion 460B21. The fifth assembly part 460B1 and a sixth assembly part 460B2 are coupled to each other by a bolt 465 that is coupled to the flange portion 460B12 of the fifth assembly part 460B1 and the second side wall portion 460B21 of the sixth assembly part 460B2 in an upward and downward direction.

According to the above-described configuration, since the fifth assembly part 460B1 and the sixth assembly part 460B2 are coupled until the flange portion 460B12 of the fifth assembly part 460B1 is placed on the end of the second side wall portion 460B21 of the sixth assembly part 460B2, the degree of coupling of the fifth assembly part 460B1 and the sixth assembly part 460B2 can be reliably controlled.

Since the first side wall portion 460B11 of the fifth assembly part 460B1 does not need to include a groove for bolt fastening, a strength of the fifth assembly part 460B1 can be maintained well.

A refrigerant and/or gas introduced into a second discharge muffler can be more reliably prevented from leaking to the outside of the second discharge muffler.

Since the bolt 465 is coupled to the flange portion 460B12 of the fifth assembly part 460B1 and the second side wall portion 460B21 of the sixth assembly part 460B2 in the upward and downward direction, workability can be improved when the bolt 465 is fastened.

A metal plate 463 is positioned on an outer surface of the flange portion 460B12 of the fifth assembly part 460B1 and an outer surface of the second side wall portion 460B21 of the sixth assembly part 460B2 to press the flange portion 460B12 of the fifth assembly part 460B1 and the second side wall portion 460B21 of the sixth assembly part 460B2 toward each other.

According to the above-described configuration, the coupling between the flange portion 460B12 of the fifth assembly part 460B1 and the second side wall portion 460B21 of the sixth assembly part 460B2 can be more reliably maintained, compared to when the flange portion 460B12 of the fifth assembly part 460B1 and the second side wall portion 460B21 of the sixth assembly part 460B2 are fastened only by the bolt 465.

However, the metal plate 463 may not be provided.

FIG. 11 is a cross-sectional view illustrating a coupling of a second muffler body (fifth assembly part) and a second muffler cover (sixth assembly part) according to a fourth embodiment of the present disclosure.

A first clip portion 460B13 is formed at an end of a first side wall portion 460B11 of a fifth assembly part 460B1, and a second clip portion 460B23 is formed at an end of a second side wall portion 460B21 of a sixth assembly part 460B2. The fifth assembly part 460B1 and the sixth assembly part 460B2 are coupled to each other by the first clip portion 460B13 and the second clip portion 460B23.

According to the above-described configuration, the coupling operation between the fifth assembly part 460B1 and the sixth assembly part 460B2 can be easily performed.

A metal plate 463 is positioned on an outer surface of the second side wall portion 460B21 to press the second side wall portion 460B21 toward the first side wall portion 460B11. However, the metal plate 463 may not be provided.

According to the above-described configuration, the coupling between the first side wall portion 460B11 of the fifth assembly part 460B1 and the second side wall portion 460B21 of the sixth assembly part 460B2 can be more reliably maintained, compared to when the first side wall portion 460B11 of the fifth assembly part 460B1 and the second side wall portion 460B21 of the sixth assembly part 460B2 are fastened only by the first and second clip portions 460B13 and 460B23.

FIG. 12 is a cross-sectional view illustrating a coupling of a second muffler body (fifth assembly part) and a second muffler cover (sixth assembly part) according to a fifth embodiment of the present disclosure.

A groove 460B14 is formed in an outer surface of a first side wall portion 460B11 of a fifth assembly part 460B1, and a protrusion 460B24 inserted into the groove 460B14 is formed at an end of a second side wall portion 460B21 of a sixth assembly part 460B2. The fifth assembly part 460B1 and the sixth assembly part 460B2 are coupled to each other by the protrusion 460B24 inserted into the groove portion 460B14.

According to the above-described configuration, the coupling operation between the fifth assembly part 460B1 and the sixth assembly part 460B2 can be easily performed.

A metal plate 463 is positioned on an outer surface of the second side wall portion 460B21 to press the second side wall portion 460B21 toward the first side wall portion 460B11.

According to the above-described configuration, the coupling between the first side wall portion 460B11 of the fifth assembly part 460B1 and the second side wall portion 460B21 of the sixth assembly part 460B2 can be more reliably maintained, compared to when the first side wall portion 460B11 of the fifth assembly part 460B1 and the second side wall portion 460B21 of the sixth assembly part 460B2 are fastened only by an interaction of the protrusion 460B24 and the groove 460B14.

However, the metal plate 463 may not be provided.

FIG. 13 is a cross-sectional view illustrating a coupling of a second muffler body (fifth assembly part) and a second muffler cover (sixth assembly part) according to a sixth embodiment of the present disclosure.

A fifth assembly part 460B1 further includes a first clip portion 460B13 positioned at an end of a first side wall portion 460B11. The fifth assembly part 460B1 and a sixth assembly part 460B2 are coupled to each other by a metal plate 463 that presses the first clip portion 460B13 of the fifth assembly part 460B1 and a bottom portion 460B22 of the sixth assembly part 460B2 toward each other.

A sealing member 461 may be positioned between the first clip portion 460B13 and the bottom portion 460B22.

According to the above-described configuration, the coupling between the fifth assembly part 460B1 and the sixth assembly part 460B2 can be reliably maintained.

FIG. 14 is a cross-sectional view illustrating a coupling of a second muffler body (fifth assembly part) and a second muffler cover (sixth assembly part) according to a seventh embodiment of the present disclosure.

A fifth assembly part 460B1 includes a first side wall portion 460B11 and a bottom portion 460B12 formed integrally with the first side wall portion 460B11, and a sixth assembly part 460B2 includes a stepwise bottom portion 460B221 coupled to a second discharge hose 800B with a metal material.

The fifth assembly part 460B1 and the sixth assembly part 460B2 are coupled to each other by a metal plate 463 that presses the bottom portion 460B12 of the fifth assembly part 460B1 and the stepwise bottom portion 460B221 of the sixth assembly part 460B2 toward each other.

A sealing member 461 may be positioned between the bottom portion 460B12 of the fifth assembly part 460B1 and the stepwise bottom portion 460B221 of the sixth assembly part 460B2.

According to the above-described configuration, the coupling between the fifth assembly part 460B1 and the sixth assembly part 460B2 can be reliably maintained.

It is apparent to those skilled in the art that the present disclosure can be embodied in other specific forms without departing from essential features of the present disclosure. Accordingly, the above detailed description should not be construed as limiting in all aspects and should be considered as illustrative. The scope of the present disclosure should be determined by rational construing of the appended claims, and all modifications within an equivalent scope of the present disclosure are included in the scope of the present disclosure.

The invention claimed is:

1. A reciprocating compressor comprising:

a hermetic container forming a sealed space;

a discharge pipe made of a first metal material and coupled to the hermetic container;

a motor including a stator and a rotor, the motor being installed in the hermetic container to generate a rotational force;

a compression unit including a connecting rod that converts a rotational force of the motor into a linear drive force, a piston connected to the connecting rod, and a cylinder into which the piston is movably inserted, the compression unit being configured to compress a refrigerant; and a discharge unit configured to discharge the refrigerant compressed in the compression unit, wherein the discharge unit includes:

at least two discharge mufflers that are separately arranged;

a first discharge hose connecting adjacent discharge mufflers of the at least two discharge mufflers; and a second discharge hose that connects a last stage discharge muffler of the at least two discharge mufflers positioned at a last stage on a discharge path of a gas to the discharge pipe, wherein the first discharge hose is formed of a flexible material, and wherein the second discharge hose is formed of a second metal material.

2. The reciprocating compressor of claim 1, wherein the at least two discharge mufflers include:

a first discharge muffler including a first muffler body and a first muffler cover coupled to the first muffler body; and a second discharge muffler including a second muffler body and a second muffler cover coupled to the second muffler body, wherein the first discharge hose connects the first discharge muffler and the second discharge muffler, and wherein the second discharge hose connects the second discharge muffler and the discharge pipe.

3. The reciprocating compressor of claim 2, wherein the first muffler body, the first muffler cover, and the second muffler body each are formed of a plastic material, and wherein the second muffler cover is formed of a third metal material.

4. The reciprocating compressor of claim 3, wherein the second discharge hose with the second metal material and the second muffler cover with the third metal material are brazing-welded to each other or are double shot molded to each other, and wherein the second discharge hose with the second metal material and the discharge pipe with the first metal material are welded to each other.

5. The reciprocating compressor of claim 3, wherein the first muffler body and the first muffler cover are laser-welded to each other, and wherein the first discharge hose with the flexible material is double shot molded to each of the first muffler cover and the second muffler body.

6. The reciprocating compressor of claim 2, wherein the second muffler body includes a first side wall portion, and wherein the second muffler cover includes a second side wall portion coupled to the first side wall portion of the second muffler body, and a bottom portion that is formed integrally with the second side wall portion and is coupled to the second discharge hose with the second metal material.

7. The reciprocating compressor of claim 6, wherein a sealing member is positioned in at least one of an area between the first side wall portion and the second side wall portion and an area between the bottom portion and an end of the first side wall portion.

8. The reciprocating compressor of claim 7, wherein a portion of the first side wall portion is positioned inside the second side wall portion, and wherein the second muffler body and the second muffler cover are coupled to each other by a bolt that is coupled to the first side wall portion and the second side wall portion in a horizontal direction.

9. The reciprocating compressor of claim 8, wherein a metal plate is positioned on an outer surface of the second side wall portion to press the second side wall portion toward the first side wall portion.

10. The reciprocating compressor of claim 8, wherein the second muffler body further includes a flange portion that protrudes outward from the first side wall portion and is placed on an end of the second side wall portion, and wherein the second muffler body and the second muffler cover are coupled to each other by a bolt that is coupled to the flange portion of the second muffler body and the second side wall portion of the second muffler cover in an upward and downward direction.

11. The reciprocating compressor of claim 10, wherein a metal plate is positioned on an outer surface of the flange portion of the second muffler body and an outer surface of the second side wall portion of the second muffler cover to press the flange portion of the second muffler body and the second side wall portion of the second muffler cover toward each other.

12. The reciprocating compressor of claim 8, wherein a first clip portion is formed at the end of the first side wall portion, and a second clip portion is formed at an end of the second side wall portion, and wherein the second muffler body and the second muffler cover are coupled to each other by the first clip portion and the second clip portion.

13. The reciprocating compressor of claim 12, wherein a metal plate is positioned on an outer surface of the second side wall portion to press the second side wall portion toward the first side wall portion.

14. The reciprocating compressor of claim 8, wherein a groove is formed in an outer surface of the first side wall portion, and a protrusion inserted into the groove is formed at an end of the second side wall portion, and wherein the second muffler body and the second muffler cover are coupled to each other by the protrusion inserted into the groove.

15. The reciprocating compressor of claim 14, wherein a metal plate is positioned on an outer surface of the second side wall portion to press the second side wall portion toward the first side wall portion.

16. The reciprocating compressor of claim 6, wherein the second muffler body further includes a first clip portion positioned at an end of the first side wall portion, wherein the second muffler body and the second muffler cover are coupled to each other by a metal plate that presses the first clip portion of the second muffler body and the bottom portion of the second muffler cover toward each other, and wherein a sealing member is positioned between the first clip portion of the second muffler body and the bottom portion of the second muffler cover.

17. The reciprocating compressor of claim 2, wherein the second muffler body includes a first side wall portion and a bottom portion that is formed integrally with the first side wall portion, wherein the second muffler cover includes a stepwise bottom portion coupled to the second discharge hose with the second metal material, wherein the second muffler body and the second muffler cover are coupled to each other by a metal plate that presses the bottom portion of the second muffler body and the stepwise bottom portion of the second muffler cover toward each other, and wherein a sealing member is positioned between the bottom portion of the second muffler body and the stepwise bottom portion of the second muffler cover.

* * * * *